United States Patent [19]

Marquis et al.

[11] 4,210,824

[45] Jul. 1, 1980

[54] TIMER CONTROLLED CONTROL SYSTEM AND TIMER CONSTRUCTION THEREFOR

[75] Inventors: Edgar E. Marquis, Newtown; James A. Draghi, Southington, both of Conn.

[73] Assignee: Robertshaw Controls Company, Richmond, Va.

[21] Appl. No.: 847,330

[22] Filed: Oct. 31, 1977

[51] Int. Cl.[2] ..... H01H 43/00

[52] U.S. Cl. ..... 307/141; 200/38 FA

[58] Field of Search ..... 200/38 FA, 38 FB; 219/10.55 R, 10.55 B, 10.55 C, 489, 492, 493; 307/139, 140, 141; 58/125 R, 125 B; 320/37, 38

[56] References Cited

U.S. PATENT DOCUMENTS

| | | | |
|---|---|---|---|
| 3,028,472 | 4/1962 | Baird | 219/489 X |
| 3,320,442 | 5/1967 | Todrank | 307/141 |
| 3,770,980 | 11/1973 | McNally | 307/141 |
| 3,824,365 | 7/1974 | Tapper | 200/38 FA X |
| 3,867,642 | 2/1975 | Ajolahi | 307/141 |
| 3,930,359 | 1/1976 | Flumm et al. | 200/38 FA X |
| 3,973,135 | 8/1976 | Scott | 219/10.55 B X |
| 4,025,804 | 5/1977 | Rickard | 219/10.55 B X |

*Primary Examiner*—James R. Scott

*Attorney, Agent, or Firm*—Candor, Candor & Tassone

[57] ABSTRACT

A timer controlled control system for an apparatus having two controlled devices and a timer construction operatively associated with the devices to operate the same, the timer construction having a single timer provided with a pair of selectors respectively operatively associated with the devices and each selector being adapted for selecting the total time period the timer is to operate both of the devices and each selector being adapted for selecting a certain percentage of the selected total time period the timer is to operate its respective device concurrently with the other device, each selector means being manually operable.

10 Claims, 11 Drawing Figures

TIMER CONTROLLED CONTROL SYSTEM AND TIMER CONSTRUCTION THEREFOR

BACKGROUND OF THE INVENTION

1. Field of the Invention

This invention relates to an improved timer controlled control system as well as to an improved timer construction for such a system or the like.

2. Prior Art Statement

A timer construction has been provided and has a single timer provided with selector means for selecting the total time period the timer is to always operate a particular one of two control devices and for thereafter selecting a certain percentage of the selected total time period the timer is to always operate the other of the two devices concurrently with the one particular device.

Such selector means of the prior known timer construction comprises a single shaft which is initially rotated to select the total time period for the operation of the one particular control device and then is adapted to be pushed axially inwardly and rotated to set the percentage of time the other particular control device is to concurrently operate with the one particular control device.

SUMMARY OF THE INVENTION

It is a feature of this invention to provide a timer construction that functions similarly to the prior known timer construction previously described but additionally permitting the selector means to select the total time period of operation for either of the control devices rather than for only one of the control devices.

In this manner, such a timer construction can be utilized for controlling the conventional cooking unit and the microwave cooking unit for an oven of a cooking apparatus in such a manner that the operator can set the timer construction so that either the microwave cooking unit or the conventional cooking unit can be operated for the entire total selected time and the non-selected unit can then be set to operate for only a certain percentage of the selected total time period.

In particular, one embodiment of this invention provides a timer controlled control system for an apparatus having two control devices and a timer construction operatively associated with the devices to operate the same, the timer construction having a single timer provided with a pair of selector means respectively operatively associated with said devices and each selector means being adapted for selecting the total time period the timer is to operate both of the devices and each selector means being adapted for selecting a certain percentage of the selected total time period the timer is to operate its respective device concurrently with the other device, each selector means being manually operable.

Accordingly, it is an object of this invention to provide an improved timer controlled control system having one or more of the novel features of this invention as set forth above or hereinafter shown or described.

Another object of this invention is to provide an improved timer construction having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
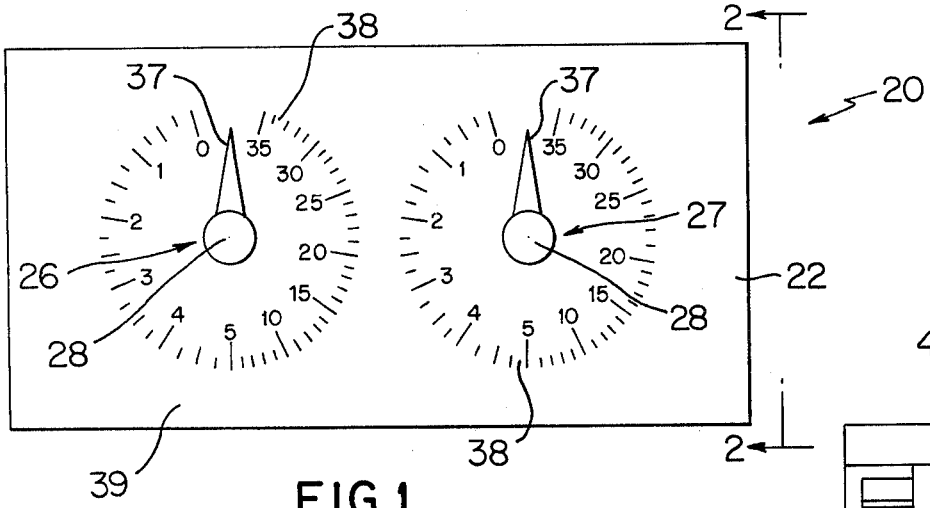
FIG. 1 is a front view of the improved timer construction of this invention.

While the various features of this invention are hereinafter illustrated and described as being particularly adapted to provide a control system for a cooking apparatus, it is to be understood that the various features of this invention can be utilized singly or in any combination thereof to provide a timer construction for other apparatus as desired.

Therefore, this invention is not to be limited to only the embodiment illustrated in the drawings, because the drawings are merely utilized to illustrate one of the wide varieties of uses of this invention.

Figure 2:
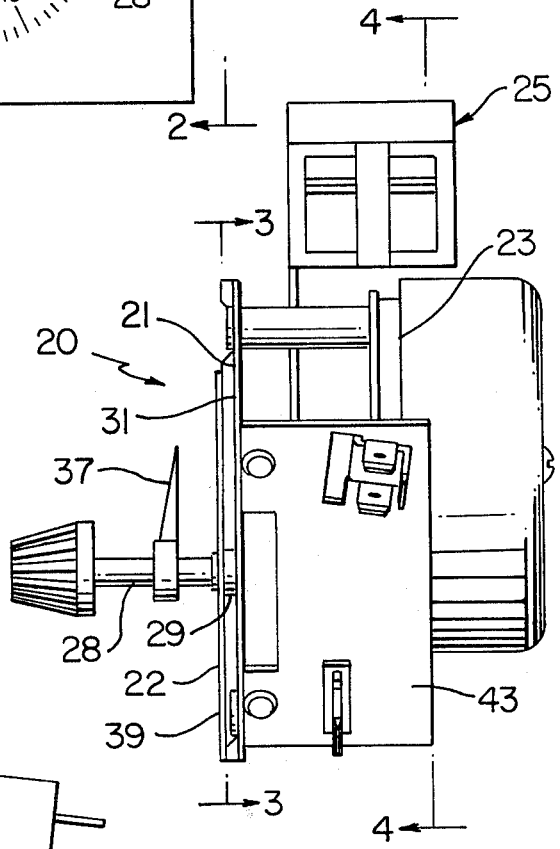
FIG. 2 is a side view of the timer construction of FIG. 1 and is taken in the direction of the arrows 2—2 thereof.

Referring now to FIGS. 1 and 2, the improved timer construction of this invention is generally indicated by the reference numeral 20 and comprises a frame means 21 carrying a front plate 22 and a single timer 23 of a conventional type that is adapted to be electrically or mechanically driven for a time period as set by a rotatable selector shaft 24 thereof (FIG. 4) in a manner well known in the art (for example, see U.S. Pat. No. 2,894,081).

Figure 4:
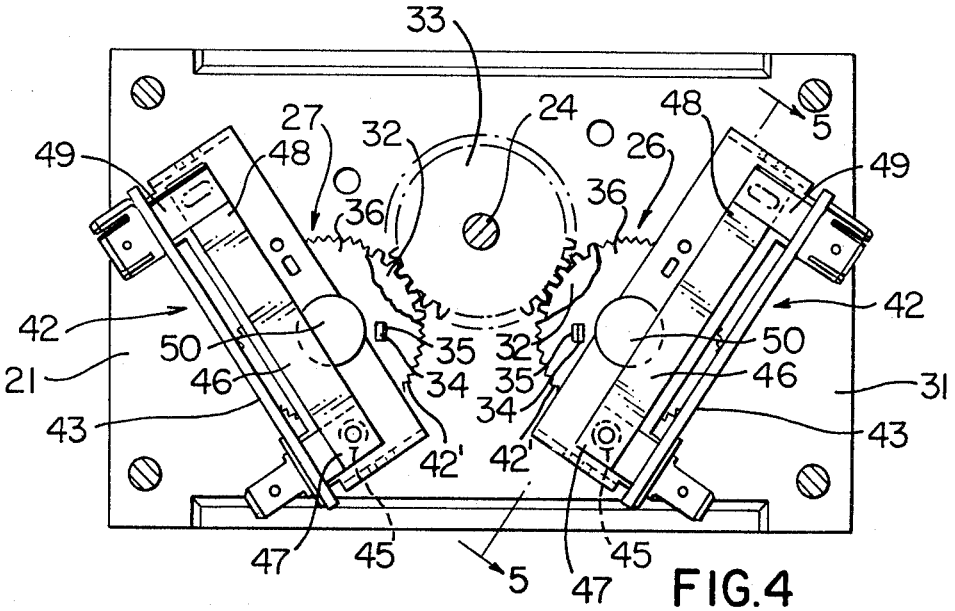
FIG. 4 is a cross-sectional view taken on line 4—4 of FIG. 2.

In particular, the conventional timer 23 is so constructed and arranged that when the selector shaft 24 is rotated from an "off" position thereof in a counterclockwise direction in FIG. 4, the same sets the timer 23 to rotate the shaft 24 in a clockwise direction in FIG. 4 back to the "off" position thereof in a timed manner determined by the amount of initial rotational movement of the shaft 24 in a counterclockwise or time setting direction in a conventional manner.

Figure 3:
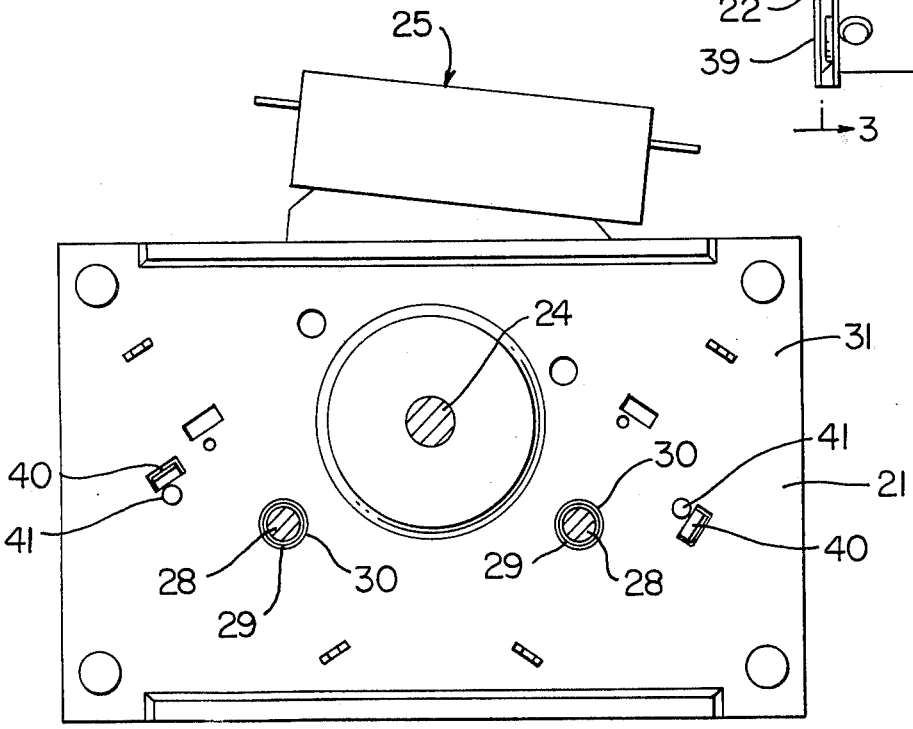
FIG. 3 is a cross-sectional view taken on line 3—3 of FIG. 2.

Thus, the timer 23, when utilized in a conventional manner normally has a knob on the shaft 24 which the operator will grasp and rotate in a counterclockwise direction so that a pointer on the knob will be rotated adjacent a scale indicating the amount of time it will take the timer to rotate the knob back to the "off" position, the conventional timer 23 normally ringing a bell when the shaft 24 returns to the "off" position and/or being adapted to maintain an electrical switch, such as the main electrical switch construction 25 in FIGS. 2 and 3, in a closed condition during the entire timed operation of the timer 23. In this manner, the switch 25 will remain closed once the shaft 24 has been rotated to a time setting position and will remain closed until the shaft 24 is returned by the timer 23 to the "off" position where the electrical switch 25 returns to its normal open position in a manner well known in the art.

Figure 5:
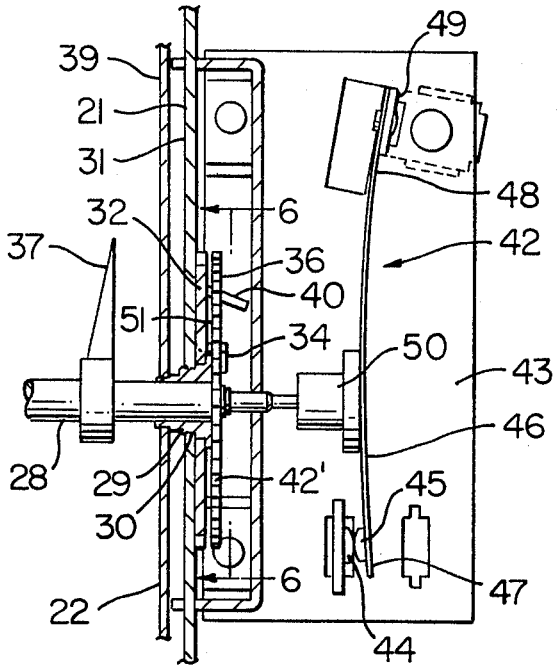
FIG. 5 is an enlarged, fragmentary, cross-sectional view taken on line 5—5 of FIG. 6.

The improved timer construction 20 of this invention utilizes such timer 23 and has two selector means that are generally indicated by the reference numerals 26 and 27 in FIG. 1 and are operatively interconnected to the timer shaft 24 in a manner hereinafter described, each selector means 26 and 27 comprising a selector shaft 28 that is rotatably and axially mounted in the frame means 21 by a bushing 29 that is rotatably mounted or fixed in an opening 30 in a frame plate 31 as illustrated in FIG. 5.

Each bushing 29 has a gear wheel 32 fastened thereto if the bushing 29 is rotatable in the frame 21 or is rotatably mounted thereon if the bushing 29 is fixed in the frame 21. In any event, each gear wheel 32 is disposed in meshing relation with a gear wheel 31 secured to the selector shaft 24 of the timer 23 whereby the gear wheels 32 of the selector means 26 and 27 always remain in mesh with the gear wheel 33 of the selector shaft 24 of the timer 23 for a purpose hereinafter described so that all of the gears 32 and 33 will rotate in unison.

Figure 6:
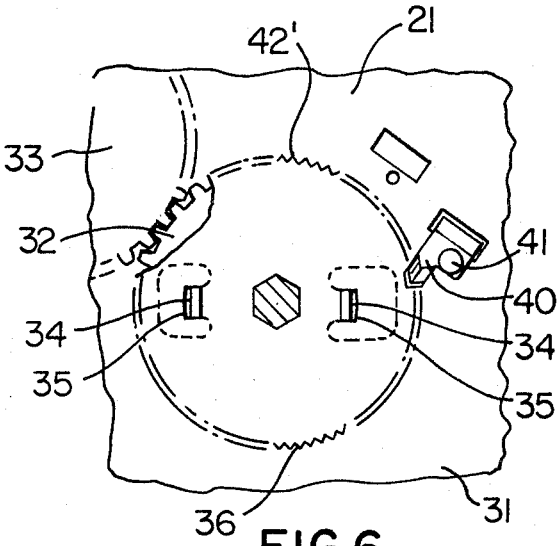
FIG. 6 is a fragmentary cross-sectional view taken on line 6—6 of FIG. 5.
Figure 7:
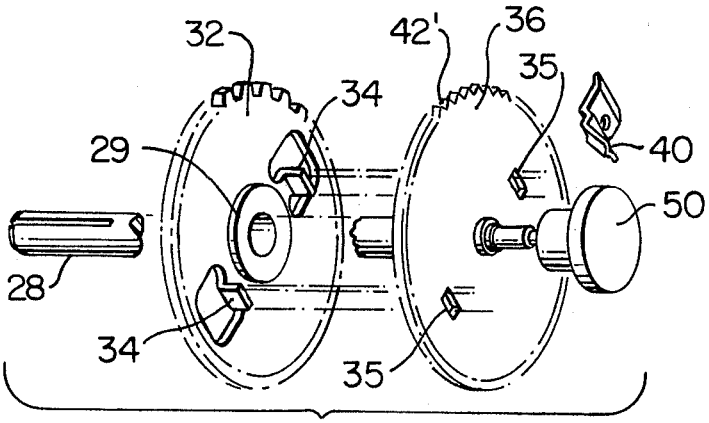
FIG. 7 is an exploded perspective view of certain parts of the selector means illustrated in FIG. 5.

As illustrated in FIGS. 6 and 7, each gear wheel 32 has a pair of drive tangs 34 extending outwardly therefrom in a direction away from the frame plate 31 and are respectively adapted to be received in cooperating slots 35 formed in a gear wheel 36 secured to the selector shaft 28 that is operatively associated therewith as illustrated.

In this manner, when the tangs 34 of the drive gear 32 are received in the slots 35 of the gear wheels 36 and the selector shafts 28 are in an axial position to the left as illustrated in FIG. 5, the wheels 32 and 36 are in driving relation with each other as will be apparent hereinafter.

However, each selector shaft 28 is adapted to be axially moved inwardly relative to the frame 21 so that the wheel 36 thereof will be carried axially inwardly therewith to clear the slots 35 thereof from the drive tangs 34 of the respective gear 32 so that once a gear wheel 36 has been moved in axially inwardly to clear the tangs 34, the selector shaft 28 thereof can be rotated relative to the gear wheel 32 to position the slots 35 out of registry with the drive tangs 34 for a purpose hereinafter described.

Figure 10:
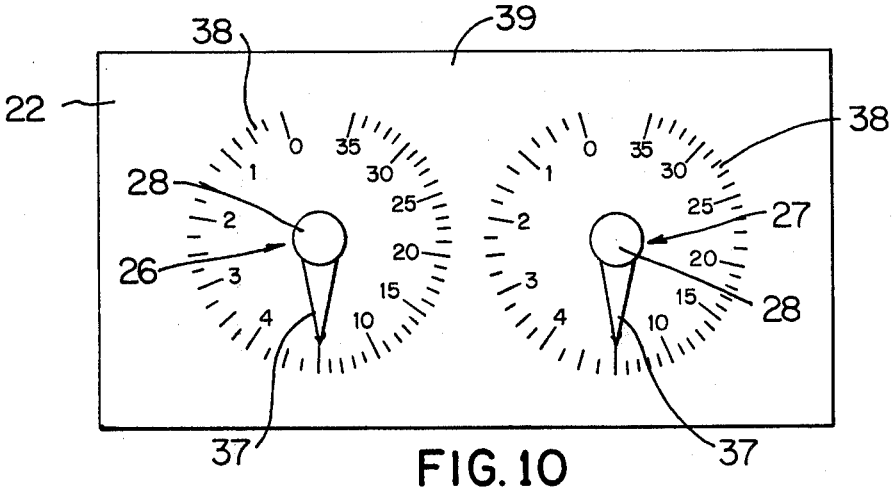
FIG. 10 is a view similar to FIG. 1 and illustrates the timer construction set in one operating condition thereof.
Figure 11:
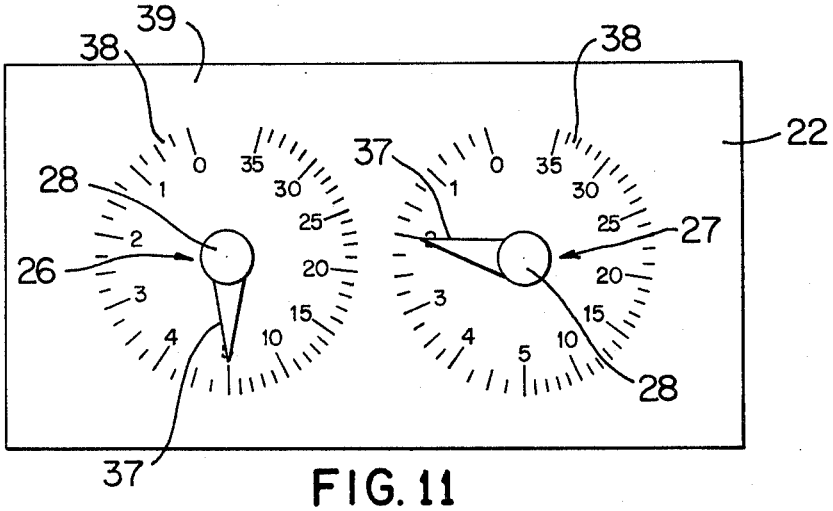
FIG. 11 is a view similar to FIG. 10 and illustrates the timer construction set in another operating position thereof.

Each selector shaft 28 carries a pointer means 37 which is settable against a suitable time scale 38 provided on the front side 39 of the front plate 22 in the manner illustrated in FIG. 1 so that when a selector shaft 28 of the selector means 26 or 27 is rotated relative to the frame means 21 in a manner hereinafter described, the pointer 37 thereof will be set against the scale 38 to indicate the amount of time set by the selector means 26 or 27, such as is illustrated in FIGS. 10 and 11 and hereinafter described.

A leaf-like spring or detent member 40 for each gear wheel 36 is fastened to the frame plate 32 by fastening means 41 to cooperate with the peripheral gear teeth 42 on the respective gear wheel 36 to hold the respective gear wheel 36 in a selected rotational position once the gear wheel 36 is out of driving relation with its respective drive gear 32 but permitting operator rotation of the gear wheel 36 relative thereto through a ratcheting operation as will be apparent hereinafter.

A pair of branch electrical switch constructions, each being generally indicated by the reference number 42, are carried by the frame plate 31 and are respectively operatively associated with the selector means 26 and 27 as will be apparent hereinafter.

Since the electrical switch constructions 42 are substantially identical in structure, only one such switch construction 42 will be described with the understanding that the other switch construction 42 has the same parts and operates in the same manner.

As illustrated in FIG. 5, each switch construction 42 has a frame plate 43 which is fastened to the main frame plate 31 in a suitable manner and carries a fixed electrical contact 44 and a movable electrical contact 45 that is normally disposed in electrical contact with the fixed contact 44 by the natural resiliency of a conductive switch blade 46 that carries the movable contact 45 on the outer free end 47 thereof, the switch blade 46 having the other end 48 thereof fixed to a terminal 49 of the frame plate 43 as illustrated.

The selector shaft 28 of the particular selector means 26 or 27 for its respective electrical construction switch 42 has a non-conductive abutment member 50 on the inner end thereof adapted to engage against the switch blade 46 intermediate its opposed ends 47 and 48 thereof as illustrated in FIG. 5 whereby the force of the switch blade 46 normally tends to hold the particular shaft 28 in its out axial position as illustrated in FIG. 5 so that the movable contact 45 can be held in contact with the fixed contact 44. Thus, the particular branch switch construction 42 normally is in its closed condition as illustrated in FIG. 5 and, at this time, the gear wheel 36 of the particular shaft 28 has its slots 35 fully receiving the drive tangs 34 of its respective drive gear 32 in the manner illustrated in FIG. 5 to permit the switch construction 42 to be in the closed condition illustrated in FIG. 5.

Figure 8:
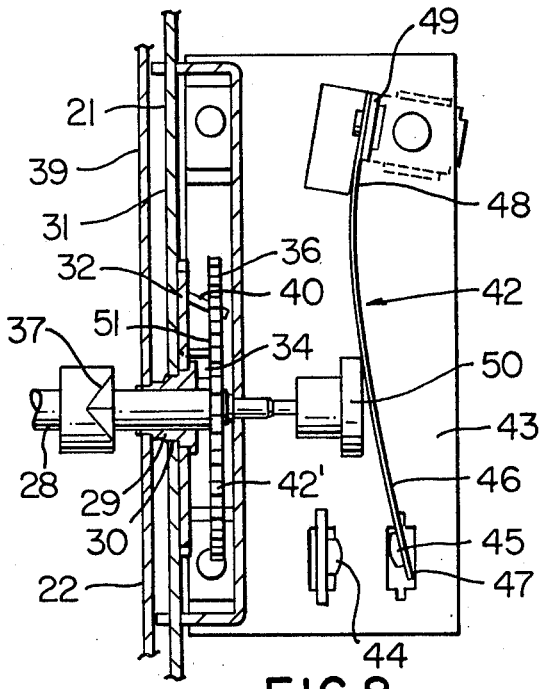
FIG. 8 is a view similar to FIG. 5 and illustrates the selector means in another operating position thereof.

However, when the particular selector shaft 28 has been moved axially inwardly to clear the slots 35 of the gear 36 thereof from the tangs 34 of the respective drive gear 32 and been rotated out of registry therewith as illustrated in FIG. 8, the shaft 28 through the abutment means 50 thereof has moved the switch blade 46 of its respective switch construction 42 to the right and thereby moved the movable contact 45 away from the fixed contact 44 to open the particular switch construction 42. However, the natural force of the switch blade 46 is to move the shaft 28 axially to the left in FIG. 8 but is prevented from doing the same because the gear 36 now has the side 51 thereof held against the drive tangs 34 to thereby hold the shaft 28 in the axial in position illustrated in FIG. 8 and, thus, maintain the particular switch construction 42 in the open condition thereof until the drive tangs 34 are again disposed in registry with the slots 35 of the gear wheel 36 to permit the switch blade 46 to axially move the gear wheel 36 to the left in FIG. 8 against the gear wheel 32 and, thus, axially move the shaft 28 therewith to the left and thereby permit the movable contact 45 to be placed in contact with the fixed contact 44 as illustrated in FIG. 5 to close the particular switch construction 42.

From the above, it can be seen that the timer construction 20 of this invention can be formed from a relatively few parts to be operated in a manner hereinafter described to provide a timer means for a timer controlled control system, such as the timer controlled control system of this invention that is generally indicated by the reference numeral 52 in FIG. 9 and will now be described.

Figure 9:
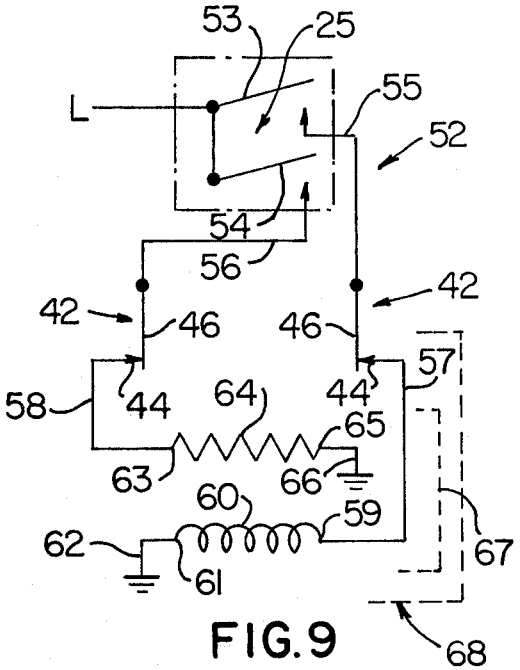
FIG. 9 is a schematic view illustrating the improved timer controlled control system of this invention utilizing the timer construction of this invention.

As illustrated in FIG. 9, the main electrical switch construction 25 of the timer 23 has a pair of movable switch blades 53 and 54 respectively interconnected to a power source lead L and normally being disposed in the open position illustrated in FIG. 9 when the timer 23 is in the "off" condition thereof so that the switch blades 53 and 54 are respectively disposed out of contact with a pair of leads 55 and 56 which respectively lead to the movable switch blade 46 of the branch switch constructions 42.

The switch blades 46 of the branch switch constructions 42 are illustrated in FIG. 9 in the normally closed positions thereof and are respectively disposed in contact with the fixed contacts 44 that are respectively interconnected to leads 57 and 58, the lead 57 being for the particular switch construction 42 that is controlled by the selector means 27 while the lead 58 is associated with the switch construction 42 for the selector means 26.

The lead 57 leads to one side 59 of a microwave cooking unit 60 that has the other side 61 thereof interconnected to ground by a lead 62.

The lead 58 of the other switch construction 42 leads to one side 63 of a conventional cooking unit or heater 64 that has the other side 65 thereof interconnected to ground by a lead 66 as illustrated.

In this manner, the conventional heater unit 64 and the microwave unit 60 can be respectively disposed in the same oven 67 of a cooking apparatus that is generally indicated by the reference numeral 68 in FIG. 9.

Accordingly, the cooking apparatus 68 can utilize the timer construction 20 of this invention to control the operation of the conventional cooking means 64 or microwave cooking means 60 for the same oven 67 in a manner now to be described.

As long as the settable timer shaft 24 of the timer means 23 is in the "off" condition of FIGS. 1 and 9, the main electrical switch construction 25 thereof is in the open condition illustrated in FIG. 9 so that no electrical energy can be supplied to either cooking means 60 or 64 even though the branch switch constructions 42 are in the closed condition illustrated in FIG. 8. Since the settable shaft 24 of the timer means 23 is in the "off" condition thereof, the same through the gear 33 thereof has positioned the gears 32 of the selector means 26 and 27 in the "off" positions thereof so that the selector shafts 28, through the interconnected gears 36, are held in the timer "off" positions illustrated in FIG. 1.

Should the operator desire to utilize the oven 67 of the cooking apparatus 68 to provide a total cooking time with the conventional heater unit 64 for five minutes and then have the microwave cooking unit 60 operate concurrently therewith during the last two minutes of the total five minute cooking time, the operator grasps the shaft 28 of the selector means 26 (or the selector means 27) and rotates the same in a counterclockwise direction from the "off" position of FIG. 1 to the time selected "on" position of FIG. 10 whereby such rotation of the shaft 28 carries its respective gear 36 therewith and through the driving relation of its slots 35 with the drive tangs 34 of its respective drive gear 32, rotates the gear wheel 32 therewith and, thus, rotates the selector gear 33 to cause the shaft 24 to rotate therewith and set the timer 23 for five minutes of operation thereof. Simultaneously with the setting of the selector shaft 28 of the selector means 26 for the five minute period, the selector shaft 28 of the other selector means 27 is automatically rotated to the five minute position illustrated in FIG. 10 through its driving relation of its gears 36 and 32 with the settable gear 33 of the timer 23.

However, since it is only desired to utilize the microwave cooking unit 60 for the last two minutes of the selected five minute cooking period, the operator then grasps the shaft 28 of the selector means 27 and pushes axially inwardly on the shaft 28 thereof to clear its respective gear 36 from the drive tangs 34 of its associated gear 32 so that the shaft 28 and its cleared gear 36 can be rotated in a clockwise direction to set the pointer 37 thereof at the two minute setting illustrated in FIG. 11.

With the timer construction 20 now set in the initial position illustrated in FIG. 11, it can be seen that the initial setting of the timer shaft 24 of the timer 23 causes the main switch construction 25 to move to a closed condition to interconnect the power source lead L to the branch switch constructions 42 and will maintain the main switch construction 25 in such closed condition during the entire five minutes of operation of the set timer means 23.

The switch construction 42 for the selector means 26 remains in the closed condition illustrated in FIG. 9 but the switch construction 42 for the selector means 27 is held in the open condition because the shaft 28 of the selector means 27 is held in the in axial position illustrated in FIG. 8 since the gear wheel 36 has its slots 35 disposed in rotatable advancement of the drive tangs 34 of its associated gear 32 whereby only the conventional heater unit 64 is supplied electrical current from the power source lead L to cause a conventional cooking operation in the oven 67.

Such conventional cooking operation in the oven 67 continues during the entire five minute period that the timer means 23 is driving the selector shaft 24 thereof back to the "off" position and, thus, through the gear 33 thereof is driving the selector shaft 28 of the selector means 26 back toward the "off" position thereof from the initial five minute setting period thereof illustrated in FIG. 11.

However, when the timer means 23 reaches the time position where only two minutes remain in the initially selected total five minute setting thereof, the drive gear 32 of the selector means 27 has been so rotated that the drive tangs 34 are now disposed in registry with the slots 35 of the gear wheel 36 of the selector means 27 so that the force of the spring blade 46 for the selector means 27 can now axially move the gear wheel 36 and selector shaft 28 axially outwardly to place the gear wheel 36 of the selector means 27 into driving relation with its respective gear 32 and permit the electrical switch construction 42 operatively associated therewith to return to the closed position illustrated in FIGS. 5 and 9. Thus, the microwave cooking unit 60 is now interconnected to the power source lead L and is operated concurrently with the conventional cooking unit 64 during the last two minutes of the timed five minute operation of the oven 67 of the cooking apparatus 68.

When the five minute setting period of the timer means 23 is completed, the selector shaft 24 of the timer means 23 has returned to the "off" position to thereby open the electrical switch construction 25 to the condition illustrated in FIG. 9 and thereby terminate the operation of the cooking units 64 and 60. As this same time, the selector shafts 28 of the selector means 26 and 27 are also returned to the "off" positions illustrated in FIG. 1 whereby the timer controlled control system 52 is now disposed in the "off" position illustrated in FIG. 9.

While the previous example of the operation of the timer controlled control system 52 had the conventional cooking unit 64 operating for the entire selected cooking period, it is to be understood that the microwave cooking unit 60 could be operated for the entire selected cooking period by initially having the selector shaft 28 of the selector means 26 turned back in its axially in position to a certain time position less than the total selected time rather than have the selector shaft 28 of the selector means 27 turned back in the manner previously described.

Therefore, it can be seen that the operator of the system 52 has the option of selecting either of the cooking units 64 or 60 for operating during the entire selected cooking time period and having the other cooking unit operate only for a desired percentage of the time of the total selected cooking time period and at the end part thereof, such desired percentage being anywhere from approximately one-hundred percent to approximately zero percent of the total selected time period.

For example, with the selector shafts 28 set in the position illustrated in FIG. 10, both units 64 and 60 will operate for one-hundred percent of the five minute cooking time period selected.

Conversely, either one of the selector means 26 and 27 while in the position of FIG. 10, or the other initial selected time period, can be rotated back in its axial in position back to the "off" position thereof of FIG. 1 so that the particular cooking unit associated therewith will be in the "off" condition thereof during the entire cooking operation of the timer means 23.

Of course, the particular selector means 26 or 27 in its axially pushed in position could be rotated in a counterclockwise direction from FIG. 10 to set the same so that the same would never turn on its particular cooking unit even though the timer means 23 has returned to the "off" position thereof.

Further, while the particular timer construction 20 of this invention has been illustrated as being utilized in the cooking apparatus 68, it is to be understood that the same could be utilized for other apparatus or systems as desired.

For example, the same could be utilized as a battery charger when a full charge is required for a period of time, then switched to a trickle charge and finally all functions shut off at the end of the time period.

Therefore, it can be seen that the improved timer controlled control system 52 of this invention has two controlled devices 60 and 64 and a timer construction 20 operatively associated with the devices 60 and 64 to operate the same, the timer construction 20 having a single timer 23 provided with selector means 26 and 27 for selecting the total time period that the timer 23 is to operate either one of the devices 60 and 64 and for selecting a certain percentage of the selected total time period that the timer 23 is to operate the other of the devices 60 and 64 concurrently with the selected one device 60 and 64.

Further, it can be seen that this invention not only provides a timer controlled control system, but also this invention provides an improved timer construction for such a control system or the like.

While the forms of the invention now preferred have been illustrated and described as required by the Patent Statute, it is to be understood that other forms can be utilized and still fall within the scope of the appended claims.

What is claimed is:

1. In a timer controlled control system for an apparatus having two controlled devices and a timer construction operatively associated with said devices to operate the same, the improvement wherein said timer construction comprises a single timer having a pair of selector means respectively operatively associated with said devices and each selector means being adapted for selecting the total timer period said timer is to operate both of said devices and each selector means being adapted for selecting a certain percentage of said selected total time period said timer is to operate its respective device concurrently with the other device, said system having an energy source, said timer construction having a main unit and two branch units, said timer having a time setting means for operating said main unit, said main unit being adapted to interconnect said energy source respectively through said two branch units to said controlled devices for a time period set by said time setting means, said pair of selector means being respectively and operatively interconnected to said time setting means so that either selector means can set said time setting means for said particular time period, and means respectively and operatively interconnecting said pair of selector means to said branch units so that either selector means can set its respective branch unit to interconnect said energy source to its respective controlled device for only said certain percentage of said particular time period whereby one of said controlled devices will be interconnected to said energy source for the entire said particular time period and the other of said controlled device will be interconnected to said energy source only for said certain percentage of said particular time period.

2. A timer controlled control system as set forth in claim 1 wherein said energy source comprises an electrical energy source and said main unit and said branch unit each comprises an electrical switch construction.

3. A timer controlled control system as set forth in claim 2 wherein each said branch switch construction is a normally closed switch construction.

4. A timer controlled control system as set forth in claim 3 wherein each selector means comprises a movable member carried by said timer and being rotatable to set said time setting means for said particular time period and being axially movable to a position to open its respective branch switch construction.

5. A timer controlled control system as set forth in claim 4 wherein each member is rotatable in said position thereof that opens its respective branch switch construction to select said certain percentage of said particular time period.

6. In a timer construction for a timer controlled control system of an apparatus having two controlled devices, said timer construction being adapted to be operatively associated with said devices to operate the same, the improvement wherein said timer construction comprises a single timer having a pair of selector means respectively being adapted to be operatively associated with said devices and each selector means being adapted for selecting the total time period said timer is to operate both of said devices and each selector means being adapted for selecting a certain percentage of said selected total time period said timer is to operate its respective device concurrently with the other device, said timer construction having a main unit and two branch units, said timer having a time setting means for operating said main unit, said main unit being adapted to interconnect an energy source respectively through said two branch units to said controlled devices for a time period set by said time setting means, said pair of selector means being respectively and operatively interconnected to said time setting means so that either selector means can set said time setting means for said particular time period, and means respectively and operatively interconnecting said pair of selector means to said branch units so that either selector means can set its respective branch unit to interconnect said energy source to its respective controlled device for only said certain percentage of said particular time period whereby one of said controlled devices will be interconnected to said energy source for the entire said particular time period and the other of said controlled devices will be interconnected to said energy source only for said certain percentage of said particular time period.

7. A timer construction as set forth in claim 6 wherein said main unit and said branch units each comprise an electrical switch construction.

8. A timer construction as set forth in claim 7 wherein each said branch switch construction is a normally closed switch construction.

9. A timer construction as set forth in claim 8 wherein each selector means comprises a movable member carried by said timer and being rotatable to set said time setting means for said particular time period and being axially movable to a position to open its respective branch switch construction.

10. A timer construction as set forth in claim 9 wherein each member is rotatable in said position thereof that opens its respective branch switch construction to select said certain percentage of said particular time period.

* * * * *